US006575299B1

(12) United States Patent
Kinigakis

(10) Patent No.: US 6,575,299 B1
(45) Date of Patent: Jun. 10, 2003

(54) MEAL KIT PACKAGING SYSTEM

(75) Inventor: Panagiotis Kinigakis, Mount Prospect, IL (US)

(73) Assignee: Kraft Foods Holdings, Inc., Northfield, IL (US)

( * ) Notice: Subject to any disclaimer, the term of this patent is extended or adjusted under 35 U.S.C. 154(b) by 25 days.

(21) Appl. No.: 09/656,157

(22) Filed: Sep. 6, 2000

(51) Int. Cl.[7] ..... A45C 11/20; B65D 17/40; B65D 85/00

(52) U.S. Cl. ..... 206/541; 229/162; 229/227; 229/231; 229/904; 426/115

(58) Field of Search ..... 206/541, 548, 206/549, 460; 229/162, 224–227, 904, 231, 229, 240; 426/115, 122

(56) References Cited

U.S. PATENT DOCUMENTS

| | | | | | |
|---|---|---|---|---|---|
| 1,311,049 | A | | 7/1919 | Crossno | |
| 2,744,624 | A | | 5/1956 | Hoogstoel et al. | |
| 3,167,181 | A | | 1/1965 | Goodman | |
| 3,240,419 | A | * | 3/1966 | Spiering et al. | 229/224 |
| 3,246,829 | A | | 4/1966 | Sexton | |
| 3,310,222 | A | * | 3/1967 | Buttery | 229/226 |
| 3,323,643 | A | | 6/1967 | Rush | |
| 3,374,884 | A | * | 3/1968 | Chinkes | 206/460 |
| 3,389,784 | A | | 6/1968 | Hendricks et al. | |
| RE26,471 | E | | 10/1968 | Meyers | |
| 3,976,241 | A | | 8/1976 | Bemiss | |
| 4,083,455 | A | | 4/1978 | Keating, Jr. | |
| 4,294,352 | A | | 10/1981 | Fitzke | |
| 4,325,482 | A | * | 4/1982 | Feeser | 229/224 |
| 4,702,378 | A | | 10/1987 | Finkel et al. | |
| 4,919,785 | A | * | 4/1990 | Willey et al. | |
| 4,946,094 | A | * | 8/1990 | Stang | |
| 5,060,852 | A | * | 10/1991 | Beckerman et al. | 229/162 |
| 5,105,971 | A | * | 4/1992 | Hertenstein et al. | |
| 6,257,403 | B1 | * | 7/2001 | Feldmeier | 206/541 |

FOREIGN PATENT DOCUMENTS

| | | | | |
|---|---|---|---|---|
| FR | 2596730 | * | 10/1987 | |
| FR | 2622544 A1 | * | 11/1987 | 229/162 |
| FR | 2783811 | * | 3/2000 | |

OTHER PUBLICATIONS

International Search Report for EP 01 30 7569 completed Jan. 2, 2002.

* cited by examiner

*Primary Examiner*—Bryon P. Gehman
(74) *Attorney, Agent, or Firm*—Fitch, Even, Tabin & Flannery

(57) ABSTRACT

A pac aging system for a meal kit that includes multiple, pre-packaged food items, optionally including a relatively massive component such as a beverage container. The packaging system generally comprises an outer container having two part a lid part and a tray part, separably joined together with a separable hinge portion and with a removable tear strip that leaves corners of the container parts reinforced so as to retain an enhanced stacking strength. Preferably, food items are supported by both the lid part and the tray part.

5 Claims, 7 Drawing Sheets

MEAL KIT PACKAGING SYSTEM

BACKGROUND OF THE INVENTION

1. Field of the Invention

The present invention relates to packaging systems for food products such as meal kits. In particular, the invention relates to a packaging system which, when opened, provides multiple food preparation modules.

2. Description of the Related Art

Meal kits, pre-packaged and ready for immediate serving, heating or cooling, have increased in popularity. Generally, meal kits contain a variety of ready-to-eat food items chosen to provide an essentially complete meal. The various food items may comprise a complete food serving, a side dish, condiments or spices provided either in a separate form or in sauces or dips. The food servings may include meat, meat products, cheese, beverage and dessert items.

In the prior art, arrangements have been provided for assembling a variety of different items in a pre-arranged kit form. For example, U.S. Pat. No. 3,167,181 provides for the packaging of various dealer-aid advertising newspaper mats on a common backer member folded to resemble a portfolio. Double-faced tape is used to secure the mats to the backer. U.S. Pat. No. 3,323,643 discloses packages for first-aid and survival kits in which individual articles are arranged in a container according to a pre-determined pattern. Several items are disposed on the lid flaps of the package and are secured thereto with pressure-sensitive adhesive. U.S. Pat. No. 3,389,784 provides a sheet of backing material to which a plurality of different survival kit items are secured, using adhesive. The sheet is folded and stored in an outer container. In U.S. Pat. No. 4,294,352 a variety of emergency kit items are disposed in a metalized foil pouch. In U.S. Pat. No. 4,702,378 a sanitary disposable baby change kit is provided. Elements of the kit are secured to a plastic backer which is folded into the form of a pouch for ready transport.

The above-mentioned arrangements are generally unsuitable for use with meal kit packaging systems. For example, a need arises in packaging meal kits for separating relatively heavy items from food items which are fragile. Further, the above arrangements do not provide self-supporting container means needed to preserve the food quality and attractiveness unique to meal kit systems. While various paperboard cartons have been made available, such s those disclosed in U.S. Pat. Nos. 3,240,419; 3,310,222; 4,083,455 and Reissue Patent No. Re. 26,471, the need remains for a commercially effective packaging systems especially adapted to the requirements of meal kit systems.

SUMMARY OF THE INVENTION

Depending on the food products involved and the taste of the consumer, the same food items of a meal kit may be served at different temperatures. In addition, consumers may prefer to serve several different food items of a meal kit at different temperatures. Accordingly, the need has arisen for packaging systems to accommodate these various consumer preferences. For example, some of the meal kits offered by a provider, such as a vegetable salad, may lend themselves to a cold serving, while a hot serving is preferred for other types of meal kits, such as pizza. As a further challenge to providers of meal kits, one individual may prefer to consume a food item, such as a meat sandwich, at a lower temperature, while another individual may prefer to consume the same food item at a heated temperature. It is desirable that a meal kit packaging system be suitable for both heading and cooling, according to individual consumer tastes.

Typically the food items of many meal kits display a wide variety of texture and softness, as well as varying susceptibility to crushing. For a variety of reasons it is desirable to provide the food items (i.e., the various components of a meal kit system) in separate, independent packages. Food items may be individually pre-packaged in a variety of different ways, including containers having removable lids, pouches, film wrap, plastic bags and small paperboard containers. Due to shipping constraints placed on commercially competitive meal kits, packaging systems for individual food items cannot provide optimal crush resistance. For example, potato chips and other low density chip products are packaged in a foil bag, being rendered susceptible to crumbling into smaller pieces under applied pressure from a heavier component of the meal kit, such as a beverage container. Other products are also susceptible to applied pressure. For example, bread sticks and pizza dough may be deformed by a heavy item placed on it. It is desirable to arrange the various food items of a meal kit so as to separate heavy and crushable items during shipping and handling and to prevent crushing and the like pressure-related damage to the food items so as to preserve the desired visual presentation of the meal kit when opened by a consumer.

Care must therefore be exercised in arranging the food items in the container during transport and handling to prevent unfavorable and unintended consequences. One problem that has arisen is that of adequately constraining food items included in the meal kit which may be heavier or more dense than the other food items. If the heavy food items are not adequately contained in a generally stable position, they may crush food items in the package and may re-arrange the contents of the package in an undesirable manner. For example, it is desirable to isolate a beverage container, when provided, from the other items in the meal kit package. At times, this may be difficult or impossible because of the relative size of the beverage container with respect to the size of the other items, and to the overall internal volume within the meal kit package. For example, certain popular food items such as pizza crusts, bread sticks and nacho chips frequently have a size as large as the major dimensions of the packaging system itself.

It is generally desirable to limit the size (and especially the ratio of package material to product weight or volume) of a commercial package, particularly packages which are sold in great numbers. As mentioned, meal kit packaging systems are becoming increasingly popular and a significant number of products units are required to meet market demand. Accordingly, attention has been paid to the overall density of meal kit packaging systems and ways for reducing void space within such systems are continually being sought. As mentioned, it is desirable to isolate heavy items from items which are crushable and deformable, an objective which is at odds with reduction of package void space. A need still remains to develop an optimized meal kit packaging system which strikes an optimal balance between competing considerations, such as those mentioned above.

Meal kits may take on various levels of complexity, depending upon the nature of the food items included. For example, a pizza meal kit may require a pizza crust to be loaded with a variety of optional toppings and then covered in a sauce. Typically, the pizza, with its toppings and sauce, must be heated in some manner, before serving. Beverages and side dishes provided in the same meal kit may be best served when chilled. Accordingly, when opening the meal kit package, food items contained in the package must be separated into two or more groups, one to be maintained in a chilled condition and the other to be heated before serving. It is desirable to provide multiple packaging components for use by a consumer in organizing the meal kit for preparation and serving.

Portability is an attractive feature of meal kits, allowing the meals to be consumed at a place in which table and chairs may not be provided. For example, a consumer may wish to enjoy a meal kit in a park setting on a bench or on an improvised seat, for example. It is important that the meal kits be self supporting when opened and remain self-supporting so as to allow a consumer to concentrate on the meal presented, rather than on preserving the integrity of a flexible package. It is further desirable that the package be separable into individual package parts to allow the consumer an ability to organize the food items as desired.

Some meal kits have become more sophisticated, requiring a number of ordered steps to be taken to prepare the meal. At the same time, considerable effort has been expended to make the advantages of meal kits available to children and young adults. It is possible to present the food items of a meal kit in such a way as to suggest the order of their assembly and use, and such is an object of the present invention. Such suggestion can be especially helpful for children and young adults in helping them to learn meal presentation skills. It is generally preferred that useful suggestions be provided in some manner other than an instruction sheet, such as by giving the consumer visual cues from the ordered arrangement of the food items within the meal kit package.

These and other objects of the present invention are provided in a meal kit packaging system for ready-to-eat food and beverage items, comprising:

a container having first and second parts joined together by a hinge;

at least one line of separation dividing the container into said first and said second parts, with one container part to be hingedly movable toward and away from the other container part so as to render the container reclosable;

the first and second parts of the container each having a support wall at least partly surrounded by containment walls upstanding from the support surface; and the first and second parts of the container having sufficient strength and stiffness to function as tray modules for food preparation and serving.

DETAILED DESCRIPTION OF THE PREFERRED EMBODIMENT

Figure 2:
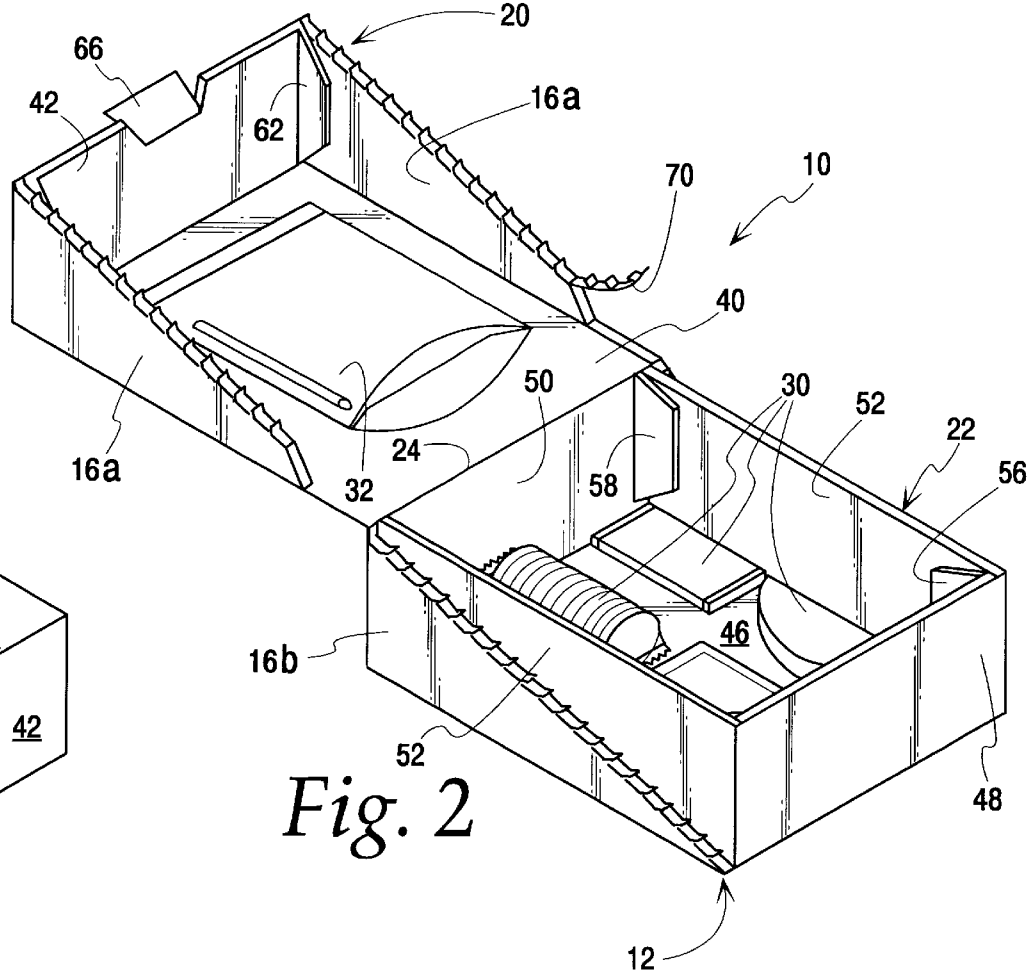
FIG. 2 shows the meal kit package in an opened position.
Figure 1:
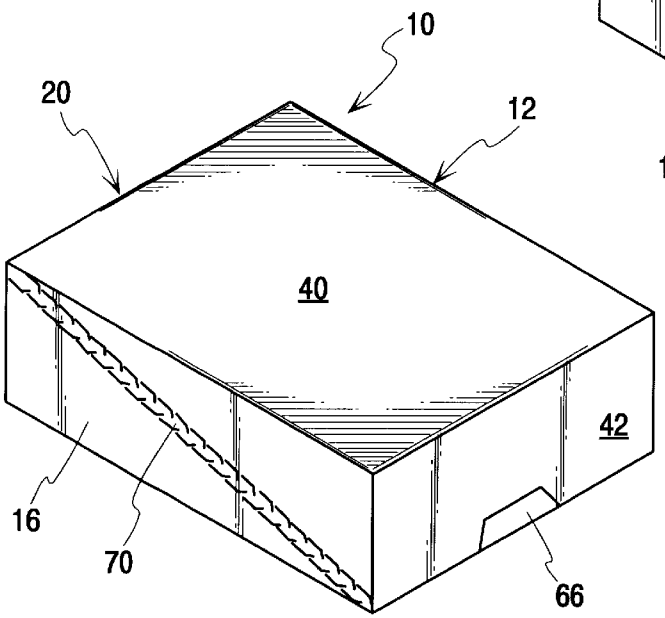
FIG. 1 is a perspective view of a meal kit packaging system according to principles of the present invention.
Figure 3:
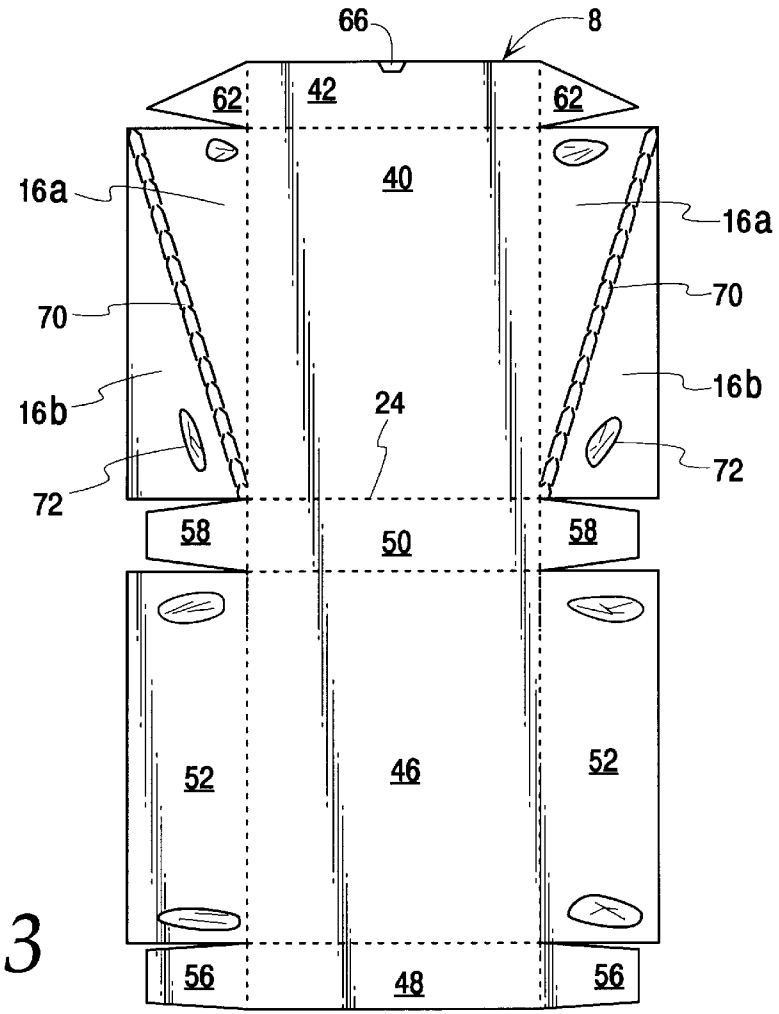
FIG. 3 is a plan view of a single piece carton blank for the meal kit system.

Referring now to the drawings and initially to FIGS. 1–3, a meal kit packaging system is generally indicated at 10. The meal kit packaging system includes a carton 12 which is generally rectilinear and is preferably formed of paperboard material, from a single carton blank 8. FIG. 3 shows the various parts of container 12 formed from the integral paperboard blank 8, with the dashed lines indicating fold lines, with fold line 24 further serving as a hinge joining a lid member and a base member together, as will be described herein. Carton 12 includes lines of separation in the form of tear strips 70 diagonally arranged along its end walls 16. When tear strip 70 is removed from carton 12, end walls 16 are divided into two portions, an upper portion 16*a* and a lower portion 16*b*. A perforated line or other line of weakness could also be used in place of the tear strip, if desired.

Referring to FIG. 2, the carton 12 is shown in an opened position with an upper tray module or lid member generally indicated at 20, hingedly joined to a lower tray module or base member 22 along the hinge line 24. Preferably, hinge line 24 is weakened so as to be selectably separable by the user, if desired. If the hinge line 24 is left intact, as illustrated in FIG. 2, carton 12 is reclosable by the user, allowing continued storage of various food items 30 and a beverage item 32. Beverage item 32 is shown in the form of a soft package or liquid-type pouch, but could also comprise an aluminum can or other conventional beverage container.

Preferably, the food items 30 are provided in separate, independent packages. Due to shipping constraints placed on commercially competitive meal kits, it is generally preferred that the packaging systems for the individual food items 30 are compact and light weight and are not capable of optimal crush resistance. Accordingly, fragile and deformable food items are rendered susceptible to damage with applied pressure from heavier components of the meal kit, such as the beverage item 32. Accordingly, it is preferred that the various food items of the meal kit are arranged so as to isolate heavy items from deformable or crushable items. It is further preferred that the isolation of heavy and soft or crushable food items be provided with a minimum of additional paperboard material, such as dividers located internally within container 12. It is most preferred that the heavy and crushable items be separated through the use of adhesives. As illustrated in FIG. 2, beverage item 32 is held in place on lid member 20 by a suitable adhesive. Accordingly, lid member 20 supports the weight of beverage container 32, thereby avoiding the need to subject food items 30 to this weight.

Turning again to FIG. 2, the lid member 20 of carton 12 includes an upper support or lid wall 40, surrounded by upstanding containment walls which include a front wall 42 and end wall portions 16*a*. Lid member 20 has the stiffness and strength to function as a tray for food preparation and serving. Efficient use of the preferred integral blank allows lid member 20 to retain its properties as a self-supporting tray whether it is left joined to the bottom portion 22 or it is separated for independent use.

Base member 22 includes a lower, bottom wall 46, front and rear walls 48, 50 and end walls 52. The partial end walls

16*b* are originally provided as part of the lid member 20 and after removal of tear strips 70 remain joined to end walls 52 of bottom member 22 by a suitable adhesive. The preferred carton blank is divided into container walls and flaps or tabs which are secured to the container walls in a manner providing improved strength and rigidity in each container part which functions as an independent, separable tray module. When combined in a reclosable container, strength and rigidity of the tray parts are combined to form the strength and rigidity of the overall container 12. For example, flaps 56 extend from front wall 48 and are secured to end walls 52, while flaps 58 extend from rear wall 50 and are secured to end walls 52, as shown in FIG. 2. The upper lid member 20 includes flaps 62 which extend from front wall 42 and are secured to end wall portions 16*a*. Upper lid member 20 also includes a hingable tab 66 formed in front wall 42 by lines of weakness, allowing a user to readily obtain a secure finger hold on lid member 20 (see FIG. 1).

If desired, the opened container 20 shown in FIG. 2 can be separated into independent tray modules by severing along hinge line 24. The upper tray module comprises the substantial portion of lid member 20, except for end wall portions 16*b* which remain secured to the second tray module comprised substantially of base member 22. Each tray module exhibits the rigidity, stiffness and strength required for stand alone support and containment of food and beverage items that a user may desire. As can be seen for example in FIG. 2, the tray module comprising the substantial portion of lid member 20 includes a major supporting surface 40 enclosed on three sides by upstanding containment walls 16*a*, 42. The tray module formed from the upper lid member is configured with the strength and rigidity needed to be self supporting, even on an irregular surface such as might be encountered in a picnic or park bench setting.

A user may wish to organize the food and beverage items in different groups. With two independent tray modules a user can separate food and beverage items into different categories, such as one category requiring heating and the other category to remain at pre-chilled temperatures. In a kitchen setting, the user may wish to organize items to be heated in a tray module. Further, either tray module can be used for heating of desired food and beverage items in a microwave oven or other heating appliance. For example, the beverage container 32 may contain a hot cocoa mix to be heated in a microwave oven along with food items such as breakfast rolls, bagels or muffins.

As can be seen in FIG. 2, the tray module formed from the upper lid member has reinforced corners, with tabs 62 overlying end wall portion 16*a*. The remaining tray module, comprised substantially of base member 22, includes a major support surface (lower bottom wall 46) bordered by four upstanding containment walls. As can be seen in FIG. 2, the corners of the lower tray module are reinforced by tabs 56, 58 and by added end wall thickness members 16*b*.

Figure 15:
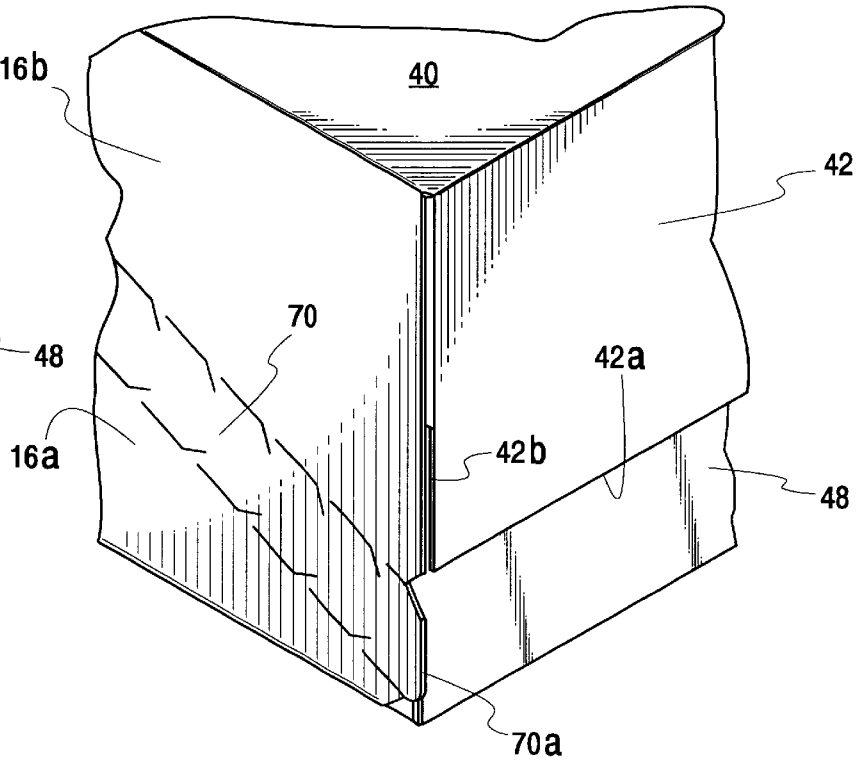
FIGS. 14 and 15 are fragmentary perspective views of variations of the carton shown in FIG. 1.
Figure 14:
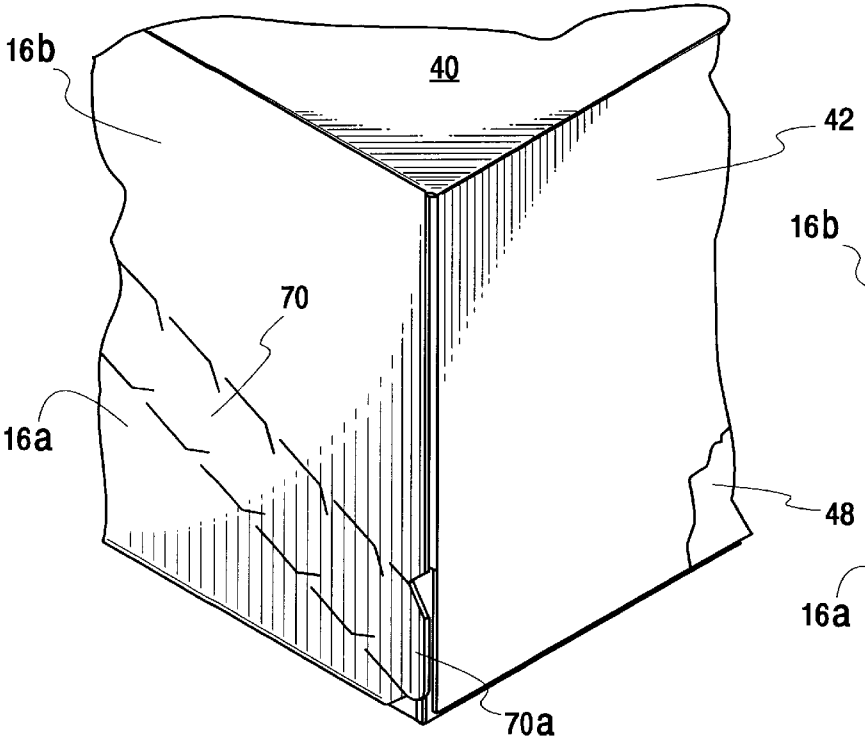

Turning now to FIG. 14, the lower central portion of FIG. 1 is shown on an enlarged scale. As shown, the leading end 70*a* of tear strip 70 has a free end located immediately adjacent front wall 42. Portions of the end wall 16 are removed adjacent leading end 70*a* to allow a user an opportunity to grasp a portion of the tear strip before tearing is initiated. Referring to FIG. 15, an alternative arrangement is shown with a shortened front wall 42. The arrangement of FIG. 15 allows a user to grasp the lower edge 42*a* of front wall 42, once tear strip 70 is removed, to open the container. As a further advantage, it is noted that the leading end 70*a* of tear strip 70 is exposed to a greater extent, further contributing to the ease with which a user can grasp the tear strip, prior to tearing. As can be seen in FIG. 15, a portion 42*b* is relieved preventing formation of a corner between front wall 42 and end wall 16. This allows the front wall 42 to be swung slightly away from front wall 48 as the container is opened, preventing inward crushing of front wall 48 which might crush or otherwise disturb fragile food items disposed within the container.

An important feature of container 12 is its ability to be top-loaded with the various food and beverage items prior to closure. This arrangement allows use of the container in an economical, high speed production line environment, where the food and beverage items are picked and placed as required to meet a particular meal kit composition. Carton 12 could, for example, be transported down an assembly line containing food and beverage items for a number of different meal kit products. After the required food and beverage items are loaded into the carton, the manufacturer lowers lid member 20 (with its lower end portion 16*b* and tear strips 70 remaining intact—see FIG. 3) onto a fully formed base member. Adhesive portion 72 shown in FIG. 3 joins end wall portions 16*b* to end walls 52, with carton 12 thereby being made ready for shipment to a consumer of the meal kit product.

With additional reference to FIG. 3, the layout of container blank 8 further adds to the inherent strength of the container when employed in a reclosable manner. For example, it will be observed that the front wall 42, upper lid wall 40, rear wall 50, lower bottom wall 46 and front wall 48 are joined together as a continuous strip of blank material. Further, tabs 56, 58 and 62 extend to join end walls to this continuous structure. Container 12 can be completely formed using conventional tray forming equipment.

As a further advantage, the carton formed from blank 8 allows top loading of food and beverage items into the container interior, prior to adhesive joinder of lid and base members by the manufacturer. When loaded by the manufacturer, the container 12 generally resembles the arrangement shown in FIG. 2, except that lower end wall portions 16*b* are joined to the upper end wall portions 16*a* by tear strips 70. If desired, container 12 can be used with cost effective computer-controlled pick and place equipment to select food and beverage items from a large variety located along an automated assembly line. With computerized control, container 12 can be advanced along the assembly line to allow picking and placing of those particular food and beverage items as may be required for a particular meal kit product. In this manner, a number of different meal kit products can be assembled from a common assembly line, for example. When all of the desired items are located in the container, and principally on the major surfaces of the lid wall and bottom wall, the lid member is lowered onto the base member bringing end wall 16 in overlying relationship with end walls 52, being secured thereto with a suitable adhesive.

Figure 4:
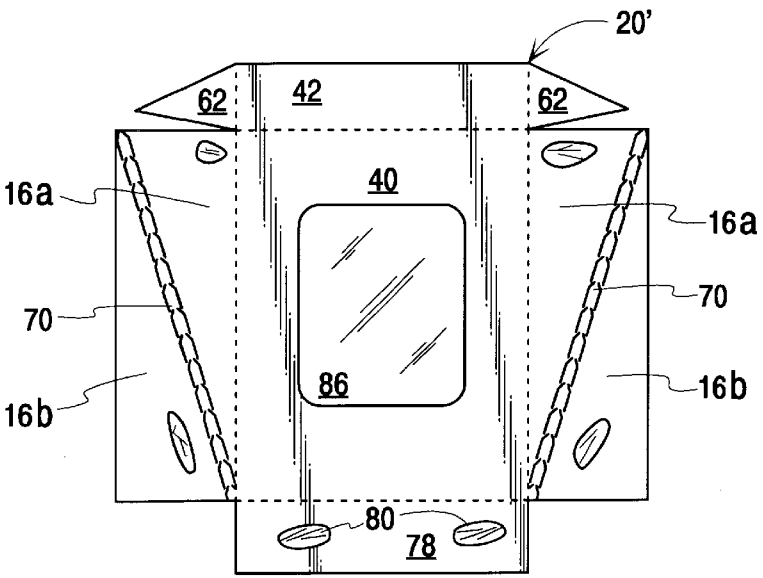
FIGS. 4 and 5 show carton blanks which, when folded and combined ether, result in the package for the meal kit system of FIGS. 1 and 2.
Figure 5:
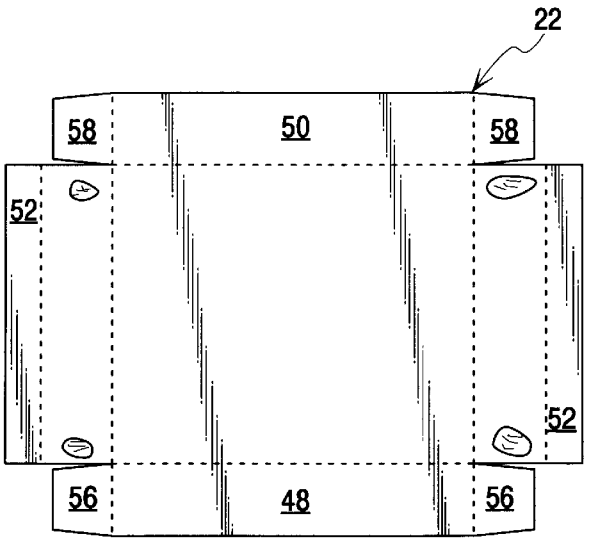

Turning now to FIGS. 4 and 5, carton 12 can be fabricated from two separate components, a lid member component 20' shown in FIG. 4 and a base member component 22 shown in FIG. 5. Using this arrangement, lid member 20' is formed to include a rear wall 78 which overlays rear wall 50 of base member 22, being secured thereto with adhesive portions 80 shown in FIG. 4. An optional window 86 is shown formed in upper lid wall 40. A sheet of translucent or transparent plastic film is secured to the inside surface of upper lid wall 40 by a suitable adhesive, thereby providing a dust seal for the window opening formed in the upper lid wall. The size and shape of window 86 can vary, as desired. For example, window 86 can be reduced in size and shifted to allow adhesive joinder of a food or beverage item to lid member 20' without obstructing view through the widow.

Figure 8:
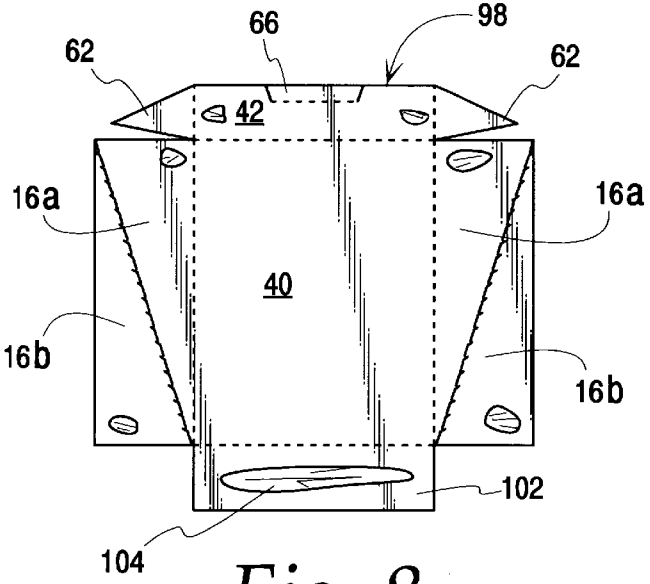
FIGS. 8 and 10 are plan views of cooperating carton blanks.
Figure 9:
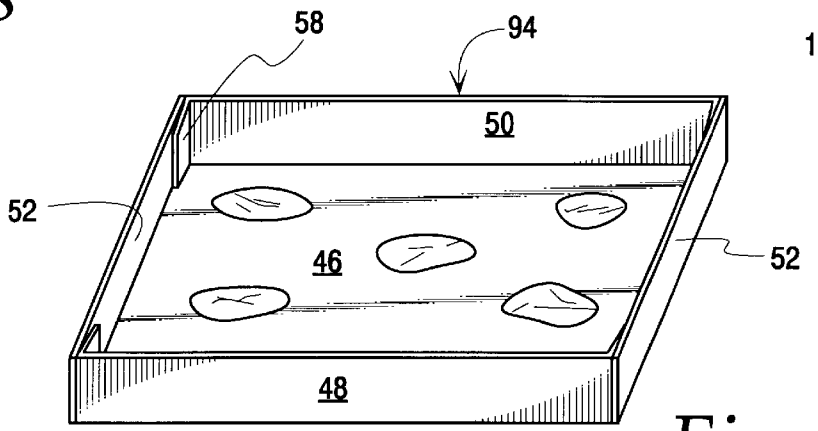
FIG. 9 shows the blank of FIG. 10 folded and assembled.
Figure 10:
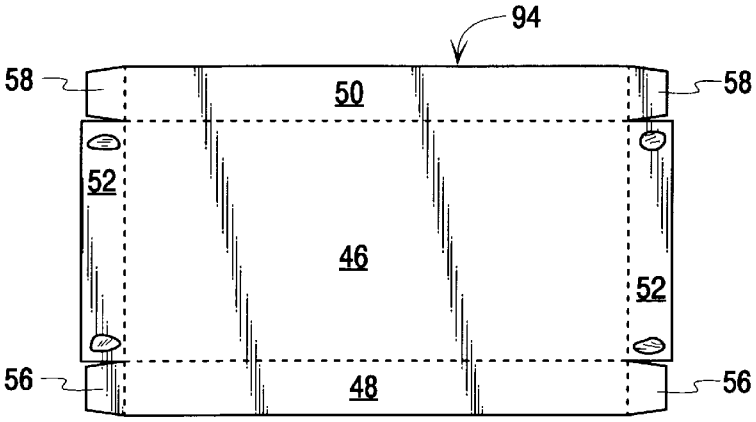

Turning now to FIGS. 6–10, a container 90 includes an upper lid member 92 and a lower base member 94. Container 90 is substantially identical to container 12 except for the substitution of a weakened line or line of separation 92, provided in place of tear strips 70. Preferably, all other features are the same as those shown and described above for carton 12. FIG. 9 shows base member 94 fully assembled and awaiting joinder with lid member portion 98, shown in FIG. 8. FIG. 9 shows optional adhesive portions which may be employed, if desired, to secure food and beverage items to the lower, bottom wall 46. FIGS. 8 and 10 show an alternative arrangement for carton 90, in which separate lid member and base member portions are provided. FIG. 8 shows a lid member portion 98 including a rear wall 102 carrying adhesive 104 for joinder to rear wall 50 of base member portion 94 shown in FIG. 10. Other features are the same as those described above for carton 90, shown in FIG. 7.

Figure 6:
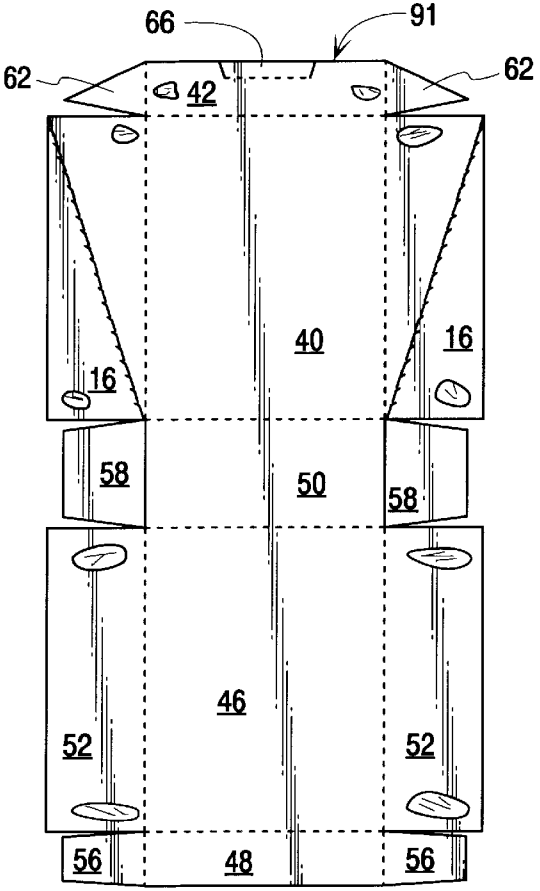
FIG. 6 is a plan view of a blank for an alternative carton for use with the meal kit system.

FIG. 6 shows the carton blank 91 from which carton 90 is formed. As can be seen by comparing FIGS. 3 and 6, carton blank 91 is substantially identical to carton blank 8 except for the substitution of weakened lines 93, preferably single perforation lines, for the tear strips 70.

Figure 12:
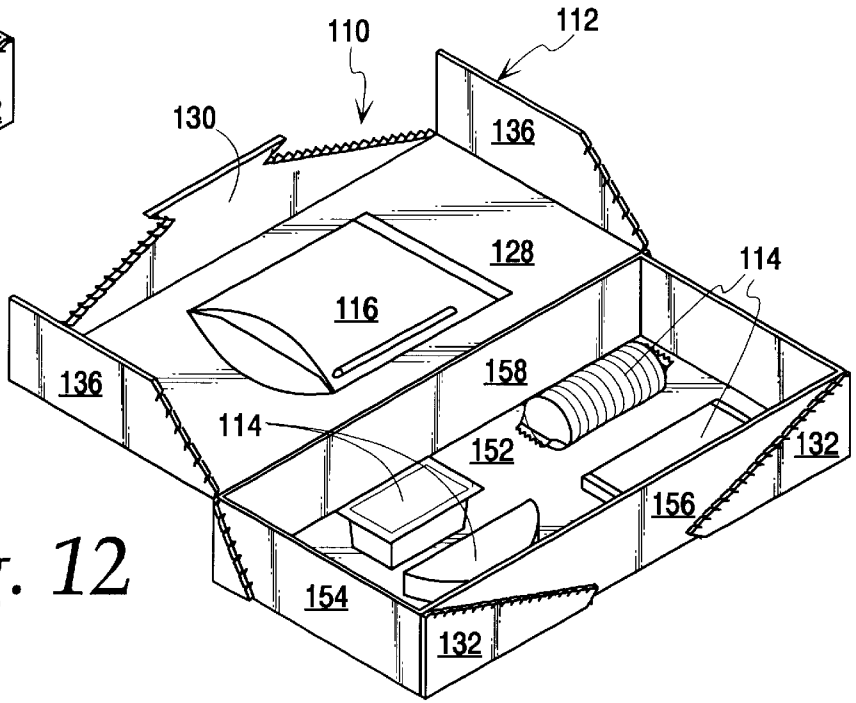
FIG. 12 is a perspective view of an alternative meal kit system.
Figure 11:
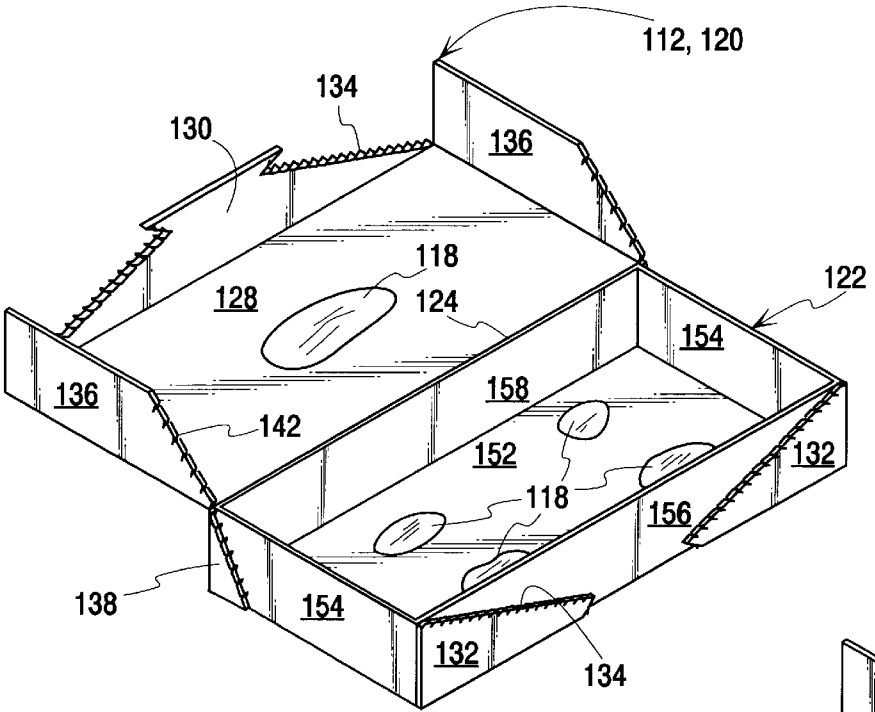
FIG. 11 is a perspective view similar to that of FIG. 12 but with the contents of the meal kit system removed.

Turning now to FIGS. 11 and 12, a meal kit is generally indicated at 110 and includes the carton 112 shown in FIG. 11. Meal kit 110 includes ready-to-eat food items 114, preferably individually wrapped and placed within container 112 in a desired, pre-determined pattern. A beverage item 116 is also provided and is shown carried on the upper portion of container 112, although, as mentioned above, the beverage item could also be obtained in the lower portion of the container. If desired, one or more food items could be carried by the upper portion of container 112. In the preferred embodiment, food and beverage items are held in place by adhesive portions 118 shown in FIG. 11.

Referring again to FIG. 11, container 112 includes a lid member 120 hingedly joined at 124 to a base member 122. Preferably, container 112 is formed from a unitary paperboard blank with hinge line 124 being provided as a line of weakness formed in the container blank. Lid member 120 includes an upper lid wall 128, a front wall comprising a center portion 130 and lateral portions 132. Base member 122 includes a lower bottom wall 152, end walls 154, a front wall 156 and a rear wall 158 joined to upper lid wall 128 by hinge line 124. FIG. 11 shows container 112 in an opened condition with a line of weakness, comprising either a tear strip or a perforated line, for example, having been severed, allowing the lid member 120 to be opened in the manner shown in FIG. 11. The lateral portions 132 remain secured to base member 122 by adhesive, not shown. Lid member 120 further includes end walls including portions 136 and 138. A line of weakness 142 has been severed to allow lid member 120 to be swung open in the manner indicated in FIG. 11. Separation of severing line 142 causes end wall portions 138 to remain secured to base member 122 by adhesive (not shown).

Preferably, hinge line 124 is readily separable by the user, when formation of separate, independent tray modules is desired. With separation along hinge line 124, lid member 120 can be discarded, leaving base member 122 with the stiffness and strength required to function as an independent tray. Food and beverage items from the meal kit can then be arranged in the base member, as desired. Alternatively, hinge line 124 can be left intact, thereby allowing container 112 to be re-closed so as to allow subsequent storage of the food and beverage items, as desired. As will now be appreciated, with re-closure, container 112 retains its original stacking strength with upper lid wall 128 coming into contact with the upper edges of base member 122, and with the base member 122, and with the base member 122 retaining its reinforced corner construction.

Figure 13:
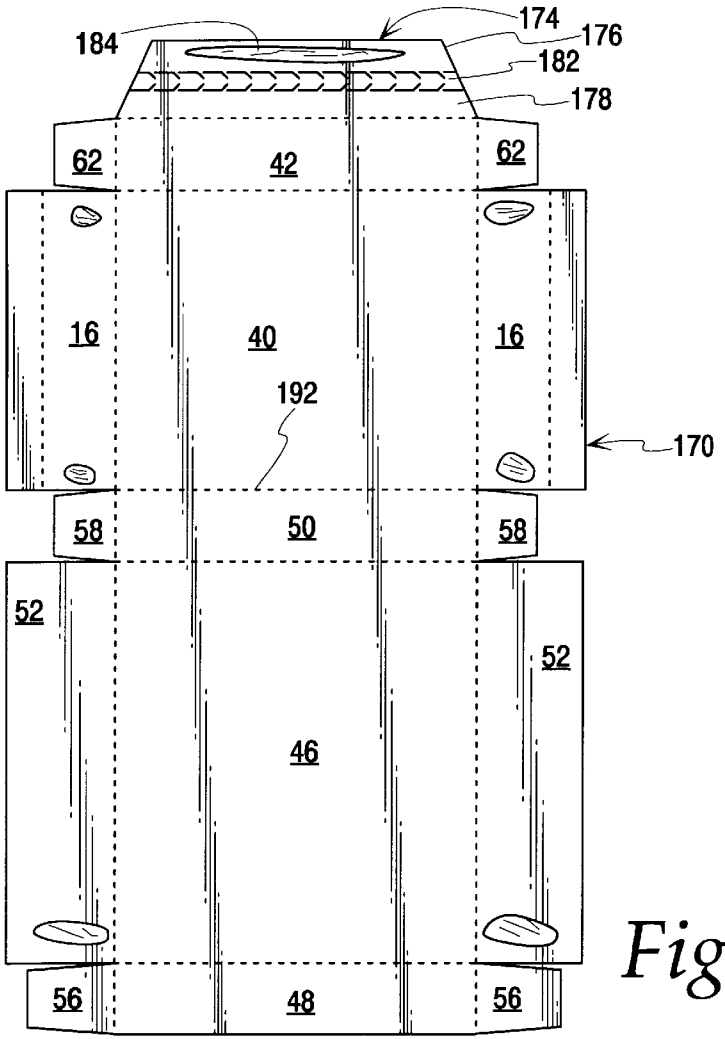
FIG. 13 is a plan view of a carton blank for an alternative carton for a meal kit assembly.
Figure 7:
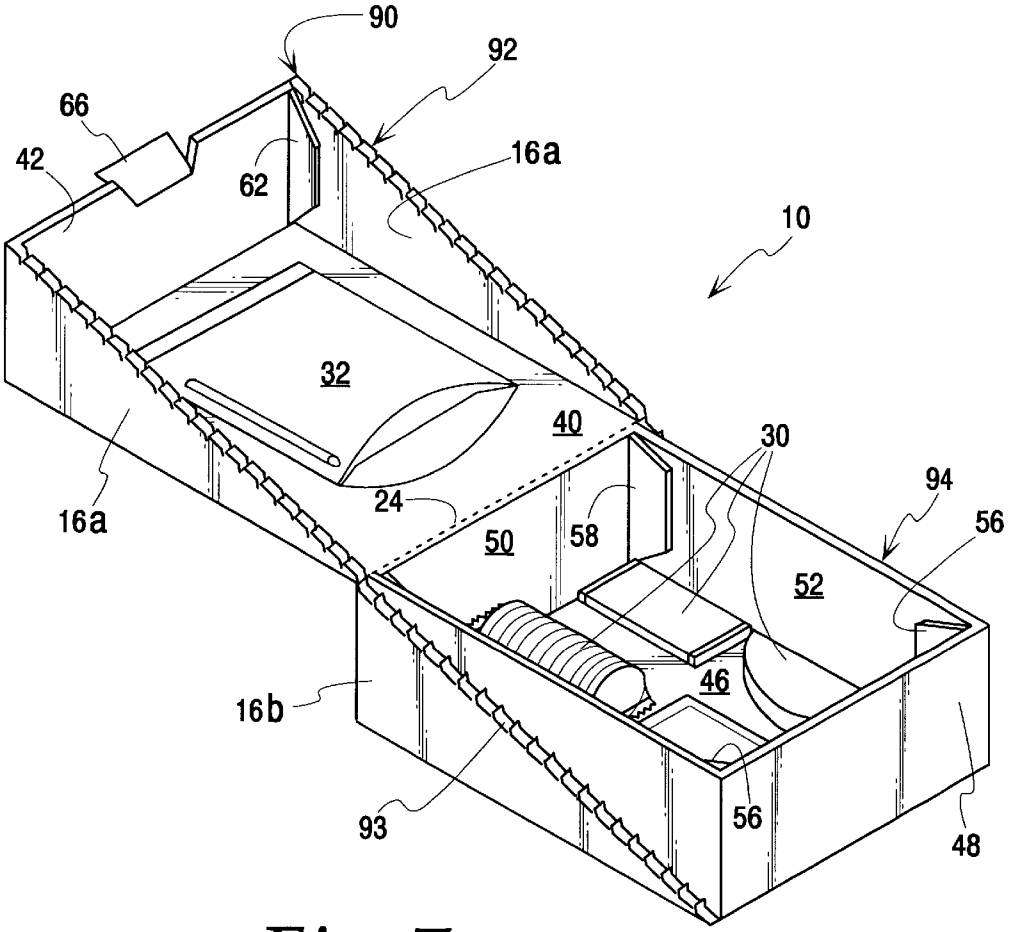
FIG. 7 shows a meal kit system with a carton constructed from the blank of FIG. 6.

Turning now to FIG. 13, a carton blank 170 is shown, for an alternative meal kit container, according to principles of the present invention. As can be seen upon comparison with FIG. 6, container blank 170 bears resemblance to container blank 91, except for the omission of diagonal lines of weakness in end wall 16 and the addition of an extra, closure wall 174 joined to front wall 42 of the base member. Closure wall 174 includes portions 176, 178 joined together by a tear strip 182. Closure wall 174 is secured by adhesive portion 184 to a front edge portion of lid member 46. With removal of tear strip 182, a user is allowed to gain access to the interior of the container and to the food and beverage items located therein. Unlike the preceding embodiments, overlying end walls of the upper lid member and lower base member are not secured together with adhesive, nor are the overlying front walls 42, 48. Accordingly, with removal of tear strip 182 the lid member is allowed to be swung away from the base member, with flexure about hinge line 192.

As can be seen from the above, meal kit packaging systems according to principles of the present invention provide an attractive, cost effective delivery of ready-to-eat food items and beverages for use in outdoor work sites and natural settings as well as kitchens and dining rooms. The package system provides separable tray modules suitable for food preparation as well as meal servings. Alternatively, the packaging system can be left intact, once opened, so as to be reclosable for storage, awaiting a subsequent meal serving when desired by the user. Further, as indicated above, packaging systems for meal kits, according to principles of the present invention, provide advantages to meal kit manufacturers by improving automated assembly of meal kits in a high speed production environment.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A carton arrangement comprising first and second integral carton blanks wherein:

the first carton blank comprises a center array disposed between first and second lateral arrays and at least partly joined to the lateral arrays by fold lines;

the center array of the first carton blank including a serial succession of a first front wall panel, a lid panel, a rear wall connector panel, the first and second lateral arrays of the first carton blank each including a serial succession of a glue tab, an outer side panel, and a rear wall glue panel;

the outer side panels of the first carton blank being rectangular and divided by respective diagonal tear strips;

the second carton blank comprises a center array disposed between first and second lateral arrays and at least partly joined to said first and said second lateral arrays by fold lines;

the center array of the second carton blank including a serial succession of a rear wall connector panel, a bottom panel and a second front wall panel; and the first and second lateral arrays of the second carton blank each including a serial succession of a rear wall glue panel, an inner side panel and a front wall glue panel.

2. The carton arrangement of claim 1 wherein said carton arrangement comprises a meal kit packaging system for ready-to-eat food and beverage items;

said first and said second integral carton blanks including surfaces comprising interior surfaces of the meal kit packaging system; and a plurality of securements carried on said interior surfaces to provide mechanical isolation of at least some of the food and beverage items from one another.

3. The carton arrangement of claim 2 wherein said securements comprise individual portions of adhesive.

4. The carton arrangement of claim 2 wherein said lid panel includes a window through which contents of the erected carton can be viewed.

5. The carton arrangement of claim 1 wherein said first and said second carton blanks are made from paperboard.

* * * * *